US012344426B2

(12) United States Patent
Hafstad

(10) Patent No.: US 12,344,426 B2
(45) Date of Patent: Jul. 1, 2025

(54) APPARATUS AND A METHOD FOR ATTACHING A LID TO A BASE PORTION

(71) Applicant: Swedish Match North Europe AB, Stockholm (SE)

(72) Inventor: Daniel Hafstad, Frillesås (SE)

(73) Assignee: SWEDISH MATCH NORTH EUROPE AB, Stockholm (SE)

( * ) Notice: Subject to any disclaimer, the term of this patent is extended or adjusted under 35 U.S.C. 154(b) by 70 days.

(21) Appl. No.: 17/999,754

(22) PCT Filed: Jun. 3, 2021

(86) PCT No.: PCT/EP2021/064936
§ 371 (c)(1),
(2) Date: Nov. 23, 2022

(87) PCT Pub. No.: WO2021/249871
PCT Pub. Date: Dec. 16, 2021

(65) Prior Publication Data

US 2023/0202694 A1 Jun. 29, 2023

(30) Foreign Application Priority Data

Jun. 10, 2020 (EP) ..... 20179254

(51) Int. Cl.
*B65B 7/28* (2006.01)

(52) U.S. Cl.
CPC ..... *B65B 7/2807* (2013.01); *B65B 7/2842* (2013.01)

(58) Field of Classification Search
CPC ..... B65B 7/2807; B65B 7/28; B65B 7/2842; B65B 1/02; B65B 43/40; B65B 43/50; B65B 43/52; B65B 5/024; B65B 7/01
See application file for complete search history.

(56) References Cited

U.S. PATENT DOCUMENTS 3,408,789 A * 11/1968 Reddick ..... B65B 7/2842 53/300
3,477,199 A 11/1969 Keas
(Continued)

FOREIGN PATENT DOCUMENTS

CN 210503312 5/2020
DE 3806512 A1 9/1989
(Continued)

OTHER PUBLICATIONS

International Search Report for PCT/EP2021/064936 dated Aug. 30, 2021.

*Primary Examiner* — Anna K Kinsaul
*Assistant Examiner* — Himchan Song
(74) *Attorney, Agent, or Firm* — Knobbe Martens Olson & Bear LLP

(57) ABSTRACT

The present invention relates to an apparatus (1) and a method for attaching a lid (103) to a base portion (102). The lid and the base portion form parts of a container, such as a user container (101) for a pouched product for oral use. The apparatus (1) comprises a support (3), a base portion feeder (5), adapted to place a base portion on the support, a 5 lid positioner (7) comprising a lid holder (9), and a mover (11), adapted to move the base portion and the lid as a combined unit (109) in a travel direction (TD). The lid positioner is movable between a lid pick-up position and a lid attachment position, the lid holder in the lid pick-up position of the lid positioner being adapted to pick up the lid. The lid holder has a front portion (19) and a rear portion (17) as seen in the travel direction when the lid 10 positioner is in the attachment position. The lid holder is, in the attachment position of the lid positioner, adapted to hold the lid in a predefinable position in relation to the base portion by the lid holder assuming an angle (α) in relation to the support, with the front portion of the lid holder being located closer to the
(Continued)

support than the rear portion of the lid holder. The mover is adapted to move the combined unit in the travel direction from the 15 rear portion towards the front portion of the lid holder.

15 Claims, 9 Drawing Sheets

(56) References Cited

U.S. PATENT DOCUMENTS

| | | | | | |
|---|---|---|---|---|---|
| 3,924,384 | A | * | 12/1975 | Kinney | B65B 7/2807 53/485 |
| 4,345,413 | A | * | 8/1982 | McCranie | B65B 7/2807 53/315 |
| 4,703,765 | A | | 11/1987 | Paules et al. | |

FOREIGN PATENT DOCUMENTS

| | | | |
|---|---|---|---|
| GB | 1291310 | A | 10/1972 |
| GB | 1425838 | A | 2/1976 |
| JP | S5489888 | | 7/1979 |
| JP | S60058308 | A | 4/1985 |
| JP | S57-185038 | | 9/2016 |
| NL | 2020908 | B1 | 11/2019 |
| WO | WO 97/21591 | A1 | 6/1997 |

* cited by examiner

APPARATUS AND A METHOD FOR ATTACHING A LID TO A BASE PORTION

CROSS REFERENCE TO RELATED APPLICATIONS

This application is a U.S. National Phase Application of PCT International Application Number PCT/EP2021/064936, filed on Jun. 3, 2021, designating the United States of America and published in the English language, which is an International Application of and claims the benefit of priority to European Patent Application No. 20179254.6, filed on Jun. 10, 2020. The disclosures of the above-referenced applications are hereby expressly incorporated by reference in their entireties.

TECHNICAL FIELD

The present invention relates to an apparatus and a method for attaching a lid to a base portion of a container, such as a user container for a pouched product for oral use.

BACKGROUND

A container intended to hold one or more products to be consumed or used often comprises a base portion intended to hold the one or more products and a lid intended to be placed on the base portion in order to form a closed container.

It is often desirable that the container is able to maintain the freshness of the one or more products for a long time. Preferably, the lid is reclosable, and it is then desirable that the lid is able to maintain the freshness of the one or more products for a long time also after the container has been opened for the first time. In order to obtain this objective, the lid may be provided with profiles, snap-in elements etc. helping the base portion and the lid to have a tight connection when the container is closed, e.g. a moisture-tight and/or gas-tight connection.

The container may be relatively easy to open by anyone, including a child. However, sometimes this is undesirable. Hence, the lid and/or the base portion may be provided with safety elements, which are intended to reduce the risk that an unsuitable person, such as a child, gets access to the content of the container. Such solutions are e.g. disclosed in patent documents WO 2017/125405 A1 and WO 2019/154971 A1.

For some pouched products for oral use stored in a container, e.g. pouched tobacco products for oral use, such as snuff products or snus products, pouched nicotine-containing products for oral use or pouched nicotine-free products for oral use, which have in common that the product is to be placed in the buccal cavity during use but is not intended to be swallowed, the container may be provided with a disposal compartment, intended to hold used products, such that the used products may be disposed of in a neat and orderly way.

The container may be a user container for pouched products for oral use, typically containing in the range of 10-30 products, such as in the range of 20-25 products. The products may be placed randomly in the user container or in a pattern, for instance as described in WO 2012/069505. The user container as disclosed herein is a consumer package having a shape and a size adapted for conveniently carrying the consumer package in a pocket or in a handbag and may be used for packaging any known type of pouched product for oral use.

The above-mentioned features of the containers, e.g. helping to keep the content fresh, making the container difficult to open for an unsuitable person and/or providing a disposal compartment, often result in that the lid and/or base portion have more sophisticated and complex geometries that just a straight wall of the base portion and a planar lid. However, such geometries may make it more difficult to position the lid on the base portion in a way that safely closes the container and yet does not risk damaging the lid and/or base portion.

Hence, there is a desire to provide an apparatus and/or a method for attaching a lid to a base portion, which method/apparatus works for sophisticated and complex geometries of the base portion and/or lid, and which reduces, or preferably avoids, the risk of damaging the lid and/or base portion during attachment of the lid.

SUMMARY

The object of the present disclosure is to overcome or ameliorate at least one of the disadvantages of the prior art, or to provide a useful alternative.

The object above may be achieved by the subject-matter of the independent claims. Embodiments are set forth in the appended dependent claims, in the following description and in the drawings.

The present invention relates to an apparatus for attaching a lid to a base portion according to claim 1. The lid and the base portion form parts of a container, such as a user container for a pouched product for oral use.

The apparatus comprises a support, a base portion feeder, adapted to place a base portion on the support, a lid positioner comprising a lid holder, and a mover, adapted to move the base portion and the lid as a combined unit in a travel direction. The lid positioner is movable between a lid pick-up position and a lid attachment position, the lid holder in the lid pick-up position of the lid positioner being adapted to pick up the lid. The lid holder has a front portion and a rear portion as seen in the travel direction when the lid positioner is in the attachment position. The lid holder is, in the attachment position of the lid positioner, adapted to hold the lid in a predefinable position in relation to the base portion by the lid holder assuming an angle $\alpha$ in relation to the support, with the front portion of the lid holder being located closer to the support than the rear portion of the lid holder. The mover is adapted to move the combined unit in the travel direction from the rear portion towards the front portion of the lid holder.

Hence, in the apparatus, the lid is picked up in the lid holder and positioned over the base portion, which is located on the support. Typically, the base portion is filled with the one or more products to be contained in the container when being fed into the lid attachment apparatus. Due to the angle $\alpha$ of the lid holder, the lid is held in a corresponding angle $\beta$ in relation to the base portion. Thereby, a front portion of the lid is closer to the base portion than a rear portion. The front portion of the lid is the leading end of the lid and the rear portion is the trailing end as seen in the travel direction. Preferably, the lid is held so close to the base portion that it abuts the base portion at the front portion. By holding the lid in contact with the base portion already from the start of the lid application process, it may be possible to achieve a more controlled initiation of the interconnection between the lid and the base portion.

Thereafter, the combined unit of the lid and the base portion are moved in the travel direction as a single unit by the mover. Due to the lower front portion of the lid holder being closer to the support than the rear portion, the lid is successively attached to the base portion by being pressed down by the front portion of the lid holder, while the combined unit is moved in the travel direction in a gap between the lid holder and the support. The distance between the lid holder and the support is adapted to heights of the base portion and lid to be combined, such that the front portion of the lid holder is able to apply an adequate pressure for correctly applying the lid on the base portion.

The lid may be provided to the lid positioner by means of a lid feeder, which may form part of the apparatus.

By the phrase "the lid being attached to the base portion" as used herein, is meant that the lid is brought into physical contact with the base portion. This successively occurs while the combined unit is moved in the travel direction in the gap between the lid holder and the support.

The lid portion may be attached to the base portion in such a way that the container is closed in the gap between the lid holder and the support. Thereby, profiles, snap-in elements etc. which are provided for forming a tight connection between the base portion and the lid when the container is closed, may be activated in the gap, e.g. by snap-in elements being brought into engagement with each other.

Alternatively, the lid is brought in a desired position in physical contact with the base portion, but the actual closure of the container is performed by a lid closure unit being separate from and located downstream of the lid holder, e.g. by an optional pressure roller described herein. In that case, profiles, snap-in elements which are provided for forming a tight connection between the base portion and the lid when the container is closed, may be brought in contact with each other by the lid holder, and subsequently activated by the lid closure unit, e.g. by the lid closure unit pressing the lid and the base portion together causing the snap-in elements on the lid and the base portion to pass each other and become interengaged.

The travel direction in the apparatus disclosed herein is defined as the direction in which the mover is adapted to move the combined unit of the lid and the base portion. The term travel direction, as used herein, indicates the route through the apparatus and possible other units in the production or assembly line. Hence, the term travel direction does not restrictedly denote a straight line, but represents a direction of travel from upstream the apparatus to downstream the apparatus.

By utilizing the apparatus as described herein, it is possible to attach the lid to the base portion in a lenient and safe way. The apparatus is in particular useful for sophisticated and complex geometries of the base portion and/or the lid. The lid application apparatus as disclosed herein ascertains that lid application may progress smoothly and without risking damage to the base portion and/or the lid, e.g. by successively interengaging a shaped edge portion of the lid with a shaped edge portion of the base portion. The geometry of the lid holder and/or the angle $\alpha$ may be adapted to the geometries of the specific lid/base portion combinations. However, the apparatus also works well for simpler geometries, such as for a container with a base portion having a straight wall and a planar lid. Accordingly, the apparatus as described herein is very versatile and works well for many different kinds of configurations of the base portion and/or lid, going from simple configurations to very complex and sophisticated ones. Moreover, the apparatus is suitable both for containers having circular cross-sections and for containers having edged cross-sections, such as square or rectangular cross-sections with rounded-off corners.

In addition, the apparatus may reduce, or even avoid, the risk of damaging the lid and/or base portion during attachment of the lid. This reduces the rejection rate of a production line.

In some prior art apparatuses, a lid is applied on a base portion from straight above. However, this puts a very high demand on that the lid and the base portion are well centered in relation to each other. If not perfectly aligned, there is a high risk that the lid and/or the base portion are damaged when the lid is attached, especially for lids and base portions having sophisticated and complex geometries, such as the features used to achieve gas-tight containers and/or avoid unsuitable users opening the containers mentioned above.

By utilizing the apparatus as disclosed herein, there is a higher tolerance than for the straight-above prior art solution as regards the centering of the lid relative to the base portion. Thereby, the base portion may be allowed to move slightly sideways on the support, such that the base portion is adjusted in relation to the lid, e.g. in a self-adjusting way. Further, due the successive attachment of the lid on the base portion, less force may be used for the attachment of the lid than for the straight-above prior art solution, i.e. less pressure may be used. This helps to reduce or avoid the risk of damages to the lid and/or base portion.

Further, in the apparatus as disclosed herein, the angle $\alpha$ may be adapted to the geometry of the lid, e.g. to lids having one or more portions projecting in a direction towards the bottom of the base portion, such as a disposal compartment or flanges or profiles used for gas-tightness or child safety. Purely as an example, such projections may project in a direction towards the base portion in the range of from 0 to 10 mm, such as from 4 to 8 mm, as measured from a top surface of the lid. An exemplary disposal compartment may e.g. project by 4 to 8 mm as measured from the top surface of the lid. It has been found that the apparatus according to the invention works well also for lids, for which the disposal compartment protrudes more than the profiles or snap-in elements used for gas-tightness or child safety. Such lids have been difficult to handle with prior art apparatuses.

The angle $\alpha$ is used to control the successive attachment of the lid to the base portion. With a low angle $\alpha$ larger portion of the lid is attached at the same time, while the combined unit is moved by the mover. The successive attachment of the lid is also influenced by the speed of the mover relative to the lid holder. Typically, the lid holder is kept still, i.e. not moved, during the successive attachment, although the lid holder has moved to position the lid in the step before that. Further, also the support may be kept still, at least during the successive attachment. In that case, the movement of the combined unit of the lid and the base portion is performed by the mover alone.

The travel direction of the base portion in the base portion feeder may coincide with the travel direction of the combined unit. In that case, a conveyor may form the support. Hence, the base portion feeder and the support may be the same unit of the apparatus. The same, or another, conveyor may form the mover. In that case, the base portion feeder, the support and the mover may be the same unit of the apparatus. For apparatuses with one or more conveyors, the lid positioner may be located such that the lids are fed from a direction being angled in relation to the travel direction, e.g. an angle being in the range of from 20° to 160°, preferably 45° to 135°, more preferably 60° to 120°, i.e. from the side. It may then be most preferable to feed the lid from a direction being perpendicular to the travel direction. Alternatively, the lids may be fed in a direction being parallel to that of the travel direction of the conveyor but with the lid positioner being located at an appropriate height above the conveyor.

As an alternative, the base portion feeder may feed the base portion from another direction than the travel direction, e.g. such that the base portion is fed into the apparatus by an angle being in the range of from 20° to 160°, preferably 45° to 135°, more preferably 60° to 120°, i.e. from the side. In that case, the lids may be fed in a direction parallel to the travel direction. However, also the lid may be fed from another direction than parallel to the travel direction.

To conclude, there is a high degree of freedom when selecting the directions for feeding the lid and the base portion, respective, both in relation to each other and in relation to the travel direction. There is further a high degree of freedom to combine two or more units of the apparatus into a single combined unit, e.g. combining the support and the base portion feeder or combining the support, the base portion feeder and the mover.

The present disclosure also relates to the use of the apparatus to put on a lid on a container. The container may be a user container for a pouched product for oral use.

The pouched product for oral use may be a pouched tobacco product for oral use, e.g. a snuff product or a snus product, a pouched nicotine-containing product for oral use or a pouched nicotine-free product for oral use.

The pouched product for oral use may be portion-packed, i.e. each pouch encloses an amount of filling material, which is intended to make up a portion of a suitable size. The pouched product for oral use is configured to fit comfortably and discreetly in a user's buccal cavity, e.g. between the upper and/or lower gum and the lip. It is not intended to be swallowed.

The pouched product for oral use described herein may be dry, semi-dry or moist. Generally, dry pouched products have a moisture content of less than 10 wt % and moist pouched products have a moisture content of above 40 wt %. Semi-dry pouched products have a moisture content between 10 wt % and 40 wt %.

As used herein the term "pouched product for oral use" may refer to a portion of smokeless tobacco or tobacco-free filling material, which may be nicotine-containing or nicotine free, packed in a saliva-permeable packaging material intended for oral use.

The pouched product may be flavourized by mixing the flavour in the filling material during manufacturing. Additionally or alternatively, the flavour may be added to the pouched product after it has been manufactured.

By the term "tobacco" as used herein is meant any part, e.g., leaves, stems, and stalks, of any member of the genus *Nicotiana*. The tobacco may be whole, shredded, threshed, cut, ground, cured, aged, fermented, or treated otherwise, e.g. granulated or encapsulated.

The term "tobacco material" is used herein for tobacco leaves or parts of leaves, such as lamina and stem. The leaves and parts of leaves may be finely divided (disintegrated), such as ground, cut, shredded or threshed, and the parts of leaves may be blended in defined proportions in the tobacco material.

The filling material may comprise a finely divided tobacco material such as a ground tobacco material or cut tobacco. In addition to the tobacco material, the filling material may further comprise at least one of the following: water, salt (e.g. sodium chloride, potassium chloride, magnesium chloride, and any combinations thereof), pH adjuster, flavouring agent, cooling agent, heating agent, sweetening agent, colorant, humectant (e.g. propylene glycol or glycerol), antioxidant, preservative (e.g. potassium sorbate), binder, disintegration aid. In an example, the filling material comprises or consists of finely divided tobacco material, salt, such as sodium chloride, and a pH adjuster.

For pouched products with no or low tobacco content, to which nicotine is added, the nicotine of the filling material may be synthetic nicotine and/or nicotine extract from tobacco plants. Further, the nicotine may be present in the form of nicotine base and/or a nicotine salt. The nicotine salt may be free, i.e. it is mixed with the other components of the product without combining chemically with said components. Additionally or alternatively, the nicotine salt may combine chemically with one or more components of the filling material. For instance, the nicotine salt may combine with alginate particles or cellulose.

As used herein, the term "moisture content" refers to the total amount of oven volatile ingredients, such as water and other oven volatiles (e.g. propylene glycol) in the preparation, composition or product referred to. The moisture content may be given herein as percent by weight (wt %) of the total weight of the preparation, composition or product referred to. If not stated otherwise, moisture content is herein given in relation to the weight of the filling material.

The moisture content as referred to herein may be determined by using a method based on literature references Federal Register/vol.74, no. 4/712-719/Wednesday, Jan. 7, 2009/Notices "Total moisture determination" and AOAC (Association of Official Analytical Chemics), Official Methods of Analysis 966.02: "Moisture in Tobacco" (1990), Fifth Edition, K. Helrich (ed). In this method, the moisture content is determined gravimetrically by taking 2.5±0.25 g sample and weighing the sample at ambient conditions, herein defined as being at a temperature of 22° C. and a relative humidity of 60%, before evaporation of moisture and after completion of dehydration. Mettler Toledo's Moisture Analyzer HB43, a balance with halogen heating technology, is used (instead of an oven and a balance as in the mentioned literature references) in the values described herein. The sample is heated to 105° C. (instead of 99.5±0.5° C. as in the mentioned literature references). The measurement is stopped when the weight change is less than 1 mg during a 90 seconds time frame. The moisture content as weight percent of the sample is then calculated automatically by the Moisture Analyzer HB43.

Pouched products for oral use may be post-moisturized after pouch formation or not post-moisturized after pouch formation. Pouched products which are not post-moisturized are herein referred to as non-post-moisturized. Post-moisturized pouched products may be produced by spraying water on the pouched product before packaging the pouched products in user containers. Post-moisturized pouches are sometimes referred to as "original" products. Non-post-moisturized pouched products are sometimes referred to as "white" products and are by some consumers considered to have a more appealing visual appearance. The moisture content of the final pouched product comprising a moist or semi-dry snuff or snus product is normally within the range of from 25 to 55 wt % based on the weight of the pouched product.

The packaging material, which is used for the pouch, is typically a nonwoven material, such as viscose. It may include a chemical binder. Nonwoven materials are fabrics that are neither woven nor knitted. Methods for the manufacturing of nonwoven materials are commonly known in the art.

Pouched products for oral use are normally sized and configured to fit comfortably and discreetly in a user's mouth between the upper or lower gum and the lip. In general, pouched products for oral use have a generally rectangular shape. Some typical shapes (length×width) of commercially available pouched products for oral use are, for instance, 35 m×20 mm, 34/35 m×14 mm, 33/34 m×18 mm, 27/28 m×14 mm, 34 mm×10 mm and 38×14 mm. Typical pouched products for oral use may have a maximum length within the range of from 25 to 40 mm along the longitudinal direction of the product and a maximum width within the range of from 5 to 20 mm along the transverse direction of the product. The thickness ("height") of the pouched product is normally within the range of from 2 to 8 mm. The total weight of commercially available pouched products for oral use are typically within the range from about 0.3 to about 3.5 g, such as from about 0.5 to 1.7 g, per pouched product.

The apparatus may comprise a single production line as in the apparatus described above. However, the apparatus may also comprise two or more production lines operating in parallel.

The angle α may be within a range of between 0° and 90°, preferably between 1° and 45°, more preferably between 2° and 30°, most preferably between 3° and 10°. An angle of 0°, which would correspond to applying the lid from straight above, i.e. with the lid holder parallel to the support is thus not included in the range. With a low angle α, a larger portion of the lid is attached at the same time, while the combined unit is moved by the mover. The angle α is preferably adapted to the geometries of the lid and the base portion.

The lid holder may have a surface adapted to the top surface of the lid. If the surface of the lid holder is planar, the angle α is measured in relation to that surface. If the surface of the lid holder is non-planar, a theoretical lid plane is taken as a mean plane of main portion of the surface of the lid holder and the angle α is measured from that theoretical plane.

The surface of the support may be horizontal and the lid holder may assume the angle α in relation to a horizontal plane when in the attachment position of the lid positioner. Thereby the base portion is held in a horizontal position, which minimizes, or preferably avoids, the risk of the one or more products held in the container falling out of it before the lid has been attached.

A front edge portion of the lid holder may comprise a lid guide, the front edge portion forming a frontmost part of the front portion of the lid holder. The lid guide may comprise an angled surface, which is angled in another direction as compared to the angle α, preferably in an opposite direction. The lid guide assumes an angle γ in relation to a surface of the remaining portion of the lid holder, wherein said angle γ is within a range of between 0° and 30°, preferably between 0° and 15°, more preferably between 1° and 10°.

The lid guide may have a maximal extension being less than half the extension of the lid, preferably in the range of 1-15 mm, more preferably in the range of 5-10 mm as measured in the travel direction, when the lid positioner is in the attachment position. The lid guide does not form part of the main portion of the surface of the lid holder defining the angle α.

The lid guide is adapted to guide the lid when it is moved from the lid feeder to the lid positioner. The lid may then be moved onto the lid holder by passing the front edge portion of the lid holder. By utilizing the lid guide as described herein, the lid is easily transferred from the lid feeder to the lid positioner. In particular, the lid guide helps to reduce, or avoid, the risk that the lid gets stuck on the front edge portion. The lid feeder may form part of the apparatus described herein.

The lid positioner comprises a rotation axis, such that the lid positioner is movable from the lid pick-up position to the lid attachment position by means of a rotation around the rotation axis. The position of the rotation axis depends on i.a. how large rotation angle the lid is to be moved. The rotation axis is located at or adjacent to the rear portion of the lid holder. Thereby, the lid is pivoted at a pivot axis located at or adjacent to the rear portion of the lid itself. This has proven to be an efficient way of positioning the lid in the desired position in relation to the base portion.

As an alternative or a complement for positioning the lid in the desired position in relation to the base portion, the support may comprise a local protrusion adapted to move a front portion of the base portion towards the lid holder. The local protrusion may e.g. be a hump or a cylinder. The local protrusion may be permanent, i.e. present all the time in the support, or the local protrusion may be activated during the lid attachment. The local protrusion helps to lift the front portion of the base portion towards the lid, such that the lid assumes the desired angle α in relation to the base portion. Thereafter, the combined unit of the lid and base portion is moved by the mover. As the combined unit passes over the local protrusion, the lid is successively attached to the base portion by the base portion being pressed upwards by the local protrusion. The local protrusion thereby has a size and location adapted such that it only presses a part of the base portion upwards, the part typically being less than half.

As yet an alternative or a complement for positioning the lid in the desired position in relation to the base portion, the lid holder may comprise a local protrusion adapted to move a front portion of the lid towards the support. The local protrusion may e.g. be a hump or a cylinder. The local protrusion may be permanent, i.e. present all the time in the lid holder, or the local protrusion may be activated during the lid attachment. The local protrusion helps to lower the front portion of the lid towards the base portion, such that the lid assumes the desired angle α in relation to the base portion. Thereafter, the combined unit of the lid and base portion is moved by the mover. As the combined unit passes below the local protrusion, the lid is successively attached to the base portion by the lid being pressed downwards by the local protrusion. The local protrusion thereby has a size and location adapted such that it only presses a part of the lid downwards, the part typically being less than half.

The apparatus may further, as an option, comprise a pressure roller located downstream of the lid positioner. The pressure roller is adapted to apply pressure to the lid, while the combined unit passes the pressure roller. The pressure roller may be used to ascertain that the lid is properly attached to the base portion. In case the container was not closed in the gap between the lid holder and the support, by the lid only being brought in physical contact with the base portion, as described above, the pressure roller may close the container by applying pressure to the lid, thereby activating profiles and/or snap-in elements e.g. by pressing the lid and the base portion together causing the snap-in elements on the lid and the base portion to pass each other and become interengaged. The pressure roller may also be used to ascertain that e.g. a label on the lid is properly attached.

The present invention further relates to a method according to claim 9 for attaching a lid to a base portion, the lid and the base portion forming parts of a container, e.g. a user container for a pouched product for oral use. The method comprises:

a) providing the lid, b) providing the base portion and placing it on a support, c) positioning the lid in a predefinable position in relation to the base portion by means of a lid holder, in which the lid assumes an angle β in relation to the base portion, with a front portion of the lid being located closer to the base portion than a rear portion of the lid, preferably the front portion of the lid abutting the base portion, d) moving the base portion and the lid as a combined unit in a travel direction going from a rear portion towards a front portion of the lid holder, such that the lid is successively attached to the base portion by the combined unit moving in the travel direction in a gap between the front portion of the lid holder and the support.

The method may be performed in the apparatus as described herein. The phrase "is attached . . . to the base portion" is explained above in conjunction with the apparatus.

In step a) one lid is fed at the time, such that the lid can be picked up by the lid holder with the lid positioner being in the pick-up position.

Step b) may be performed by the base portion feeder described herein.

Step c) may be performed by the lid positioner described herein. In that case, the angle β of the lid in relation to the base portion is directly or indirectly given by the angle α between the support and the lid holder. Purely as an example, if both the support and the lid holder have planar surfaces, the lid has a planar or substantially planar top surface held against the lid holder and the base portion has a planar or substantially planar bottom and a straight wall of equal height, the angles α and β typically coincide.

The moving in step d) may be performed by the mover described herein.

The angle β may be within a range of between 0° and 90°, preferably between 1° and 45°, more preferably between 2° and 30°, most preferably between 3° and 10°. With a low angle β, a larger portion of the lid is attached at the same time, while the combined unit is moved by the mover. The angle β is preferably adapted to the geometries of the lid and the base portion. As mentioned above, the angle β may be given by the angle α between the support and the lid holder. An angle of 0°, which would correspond to applying the lid from straight above, i.e. with the lid parallel to the base portion is not included in the range.

Step c) comprises positioning the lid in the predefinable position in relation to the base portion by means of rotation around a rotation axis. The position of the rotation axis depends on i.a. how large a rotation angle the lid is to be moved. The rotation axis is located at or adjacent to the rear portion of the lid holder. Thereby, the lid is pivoted at a pivot axis, i.e. the rotation axis, located at or adjacent to the rear portion of the lid itself. This has proven to be an efficient way of positioning the lid in the desired position in relation to the base portion.

As an alternative or a complement, step c) may comprise positioning the lid in the predefinable position by means of moving a front portion of the base portion towards the lid by means of the support. This may be performed with the local protrusion of the support described herein.

As yet an alternative or a complement, step c) may comprise positioning the lid in the predefinable position by means of moving the front portion of the lid towards the base portion by means of the lid holder. This may be performed with the local protrusion of the lid holder described herein.

Hence, the successive attachment of the lid to the base portion may be achieved in any of the ways described for the apparatus herein or a combination of those ways, such as rotating the lid, locally lifting the base portion towards the and/or locally pressing the lid towards the base portion.

The method may further comprise e) applying pressure to the lid by means of a pressure roller, while the combined unit passes the pressure roller.

Step e) may be performed by the pressure roller described herein in conjunction with the apparatus.

The pressure roller may be used to ascertain that the lid is properly attached to the base portion. In case the container was not closed in the gap between the lid holder and the support, by the lid only being brought in physical contact with the base portion, the pressure roller may close the container by applying pressure to the lid, e.g. thereby activating snap-in elements. The pressure roller may also be used to ascertain that e.g. a label on the lid is properly attached.

As set out herein, the pressure roller may be an auxiliary lid closure unit which is provided in order to ascertain that the lid has been properly closed after an earlier lid closure step. Alternatively, the pressure roller may constitute the only lid closure unit in the apparatus for attaching a lid as disclosed herein.

BRIEF DESCRIPTION OF THE DRAWINGS

The present invention will hereinafter be further explained by means of non-limiting examples with reference to the appended drawings wherein.

It should be noted that the appended drawings are not necessarily drawn to scale and that the dimensions of some features of the present invention may have been exaggerated for the sake of clarity.

DETAILED DESCRIPTION

The invention will in the following be exemplified by embodiments. It should however be realized that the embodiments are included in order to explain principles of the invention and not to limit the scope of the invention, defined by the appended claims. Details from two or more of the embodiments may be combined with each other.

Figure 1A:
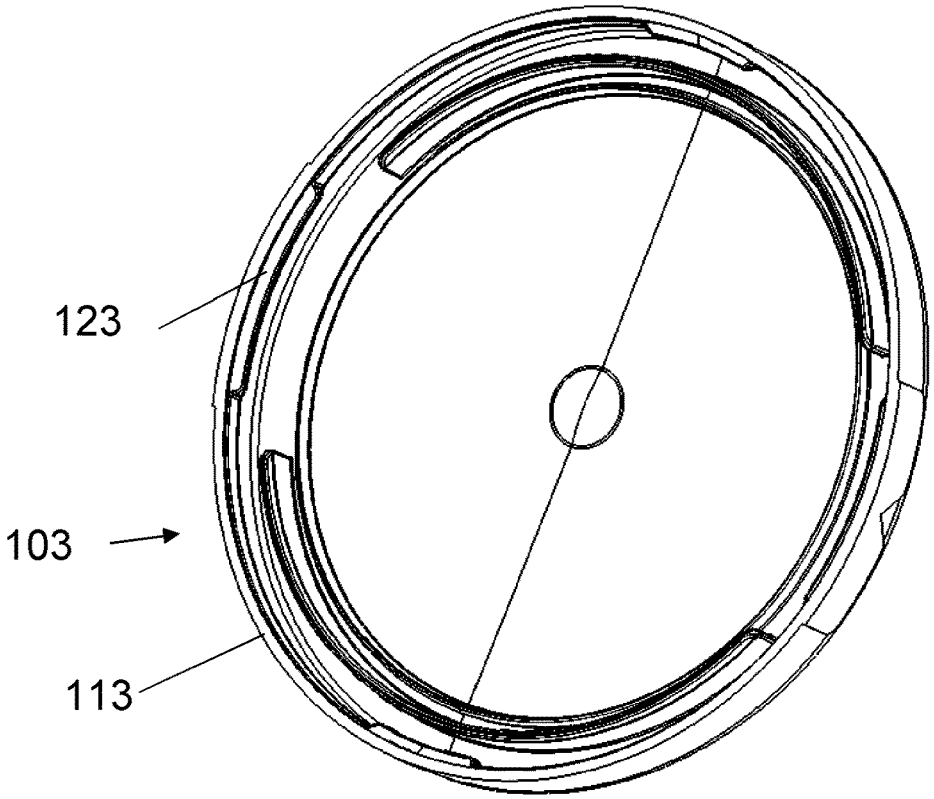
FIG. 1*a-b* illustrate a lid and a base portion of a user container.
Figure 1B:
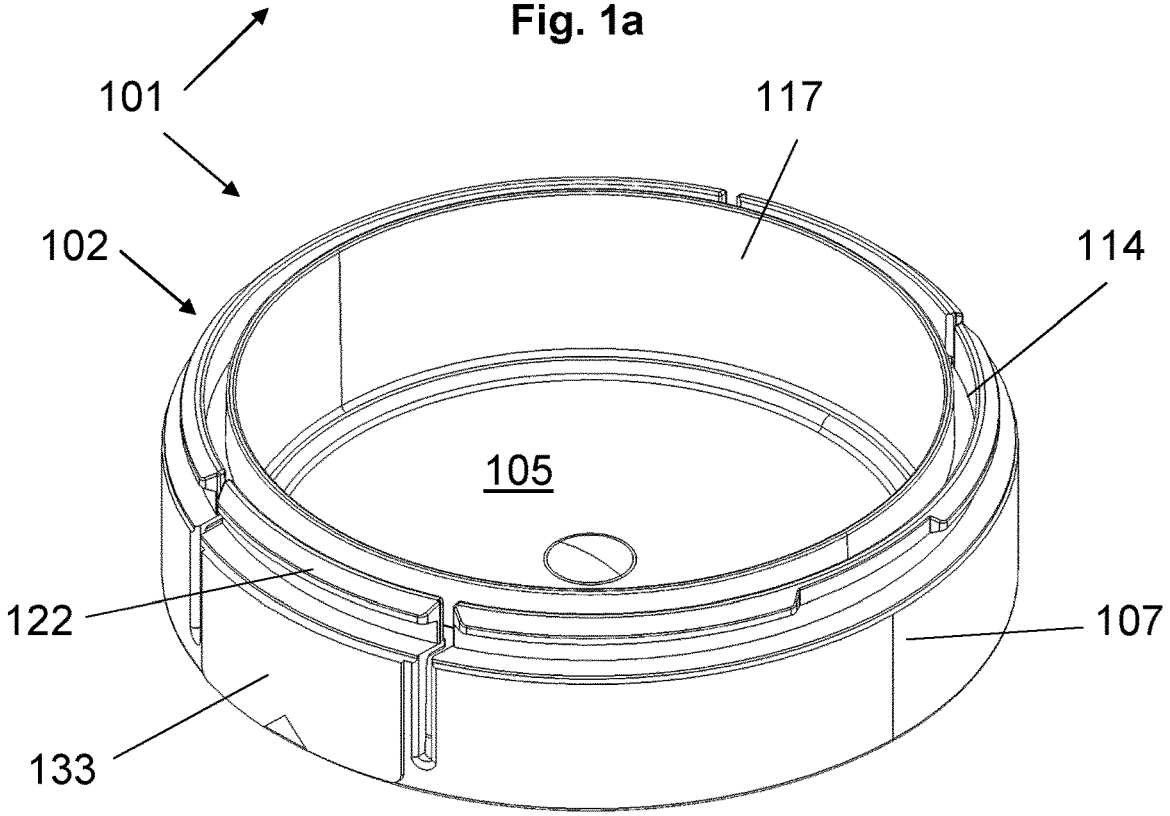

FIG. 1*a-b* illustrate a commercially available user container 101 for a pouched product for oral use. The user container 101 comprises a base portion 102 and a lid 103. The user container 101 is a child-resistant container of the type described in WO 2017/125405, to which document reference is made for details of the user container. FIG. 1*a* and FIG. 1*b* illustrate the lid 103 and the base portion 102 as separate components. The lid 103 is to be attached on the base portion 102 to form the user container 101.

The user container 101 is provided with a locking arrangement for locking the lid 103 on the base portion 102. The base portion 102 comprises a bottom wall 105, a base side wall 107 and a compartment wall 117 arranged inward of the base side wall 107 with a space 114 between the base side wall 107 and the compartment wall 117. A portion of the base side wall 107 is formed by a resiliently flexible tongue 133, with an upper part of the tongue 133 being inwardly deflectable in a direction towards the compartment wall 117. The locking arrangement comprising a first locking member 122, arranged on an upper part of the resiliently flexible tongue 133, and a second locking member 123, arranged on the lid 103 at a lid side wall end edge 113. The locking arrangement 120 is arranged to assume a locked configuration and a release configuration, in which the upper part of the resiliently flexible tongue 133 is in an inwardly deflected position.

Hence, the user container 101 comprises a number of safety elements, such as the first locking member 122, the second locking member 123 and the tongue 133, which are intended to reduce the risk that an unsuitable person, such as a child, gets access to the content of the user container 101. However, at the same time, these safety elements result in sophisticated and complex geometries of the base portion 102 and the lid 103. Consequently, if attaching the lid 103 from straight above, as in some prior art apparatuses, it is very important that the base portion 102 and the lid 103 are well centered in relation to each other, since otherwise the safety elements risk getting damaged by the force used to attach the lid 103.

Figure 2A:
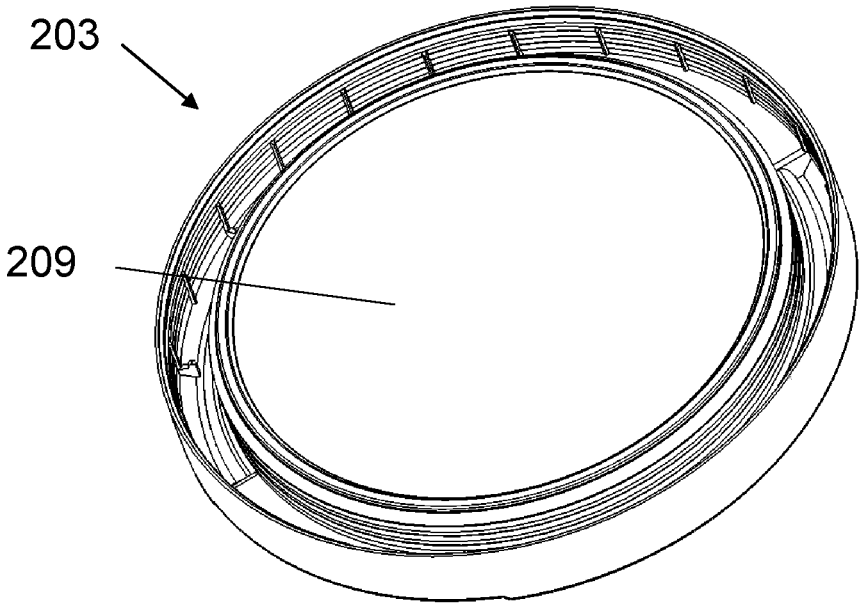
FIG. 2*a-c* illustrate a lid and a base portion of another user container.
Figure 2B:
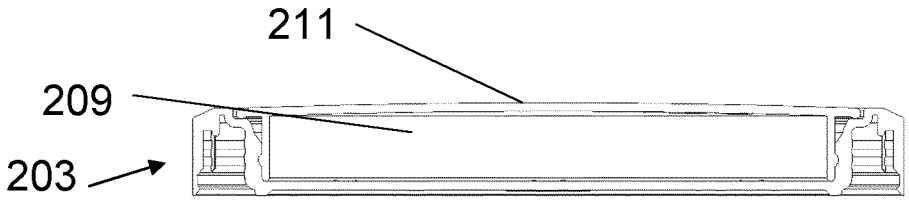
Figure 2C:
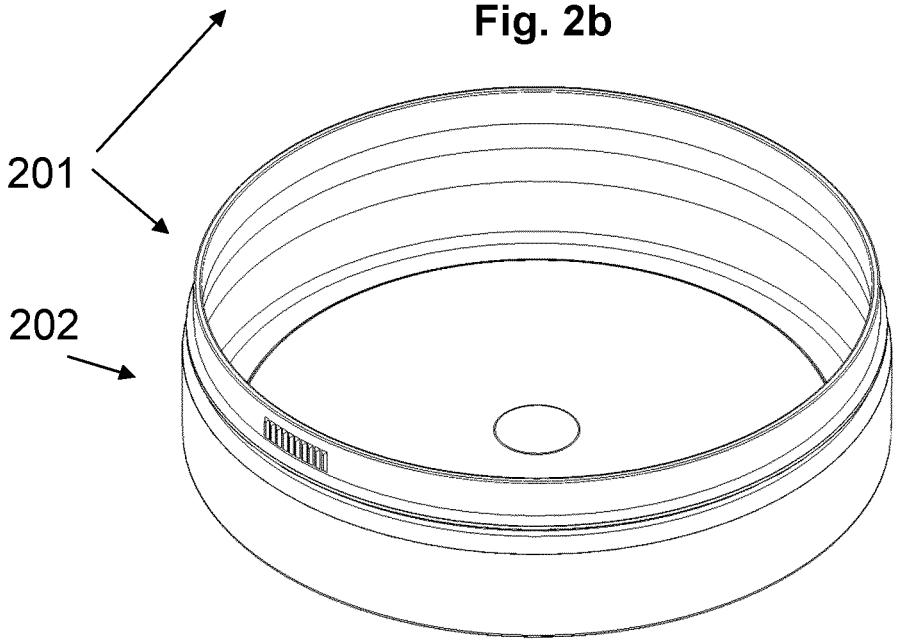

FIG. 2*a-c* illustrate another commercially available user container 201 for a pouched product for oral use. The user container 201 comprises a base portion 202, see FIG. 2*c*, and a lid 203, see FIG. 2*a*. FIG. 2*b* illustrates a cross-section of the lid 203. The lid 203 is provided with a disposal compartment 209, intended to hold used products, such that the used products may be disposed of in a neat and orderly way. An exemplary disposal compartment 209 may project by 4-8 mm as measured from a top surface 211 of the lid 203. Hence, also the user container 201, comprising the disposal compartment 209, has a more complex geometry than a standard user container with a planar lid.

Both illustrated user containers 101, 201 are configured to maintain the freshness of the one or more products contained in the user containers 101, 201 for a long time, also after the user containers 101, 201 have been opened for the first time. In order to obtain this objective, the lids 103, 203 are provided with interconnectable features such as profiles, snap-in elements etc. helping the base portion 102, 202 and the lid 103, 203 to have a tight connection when the user container 101, 201 is closed, e.g. a moisture-tight and/or gas-tight connection.

Figure 3:
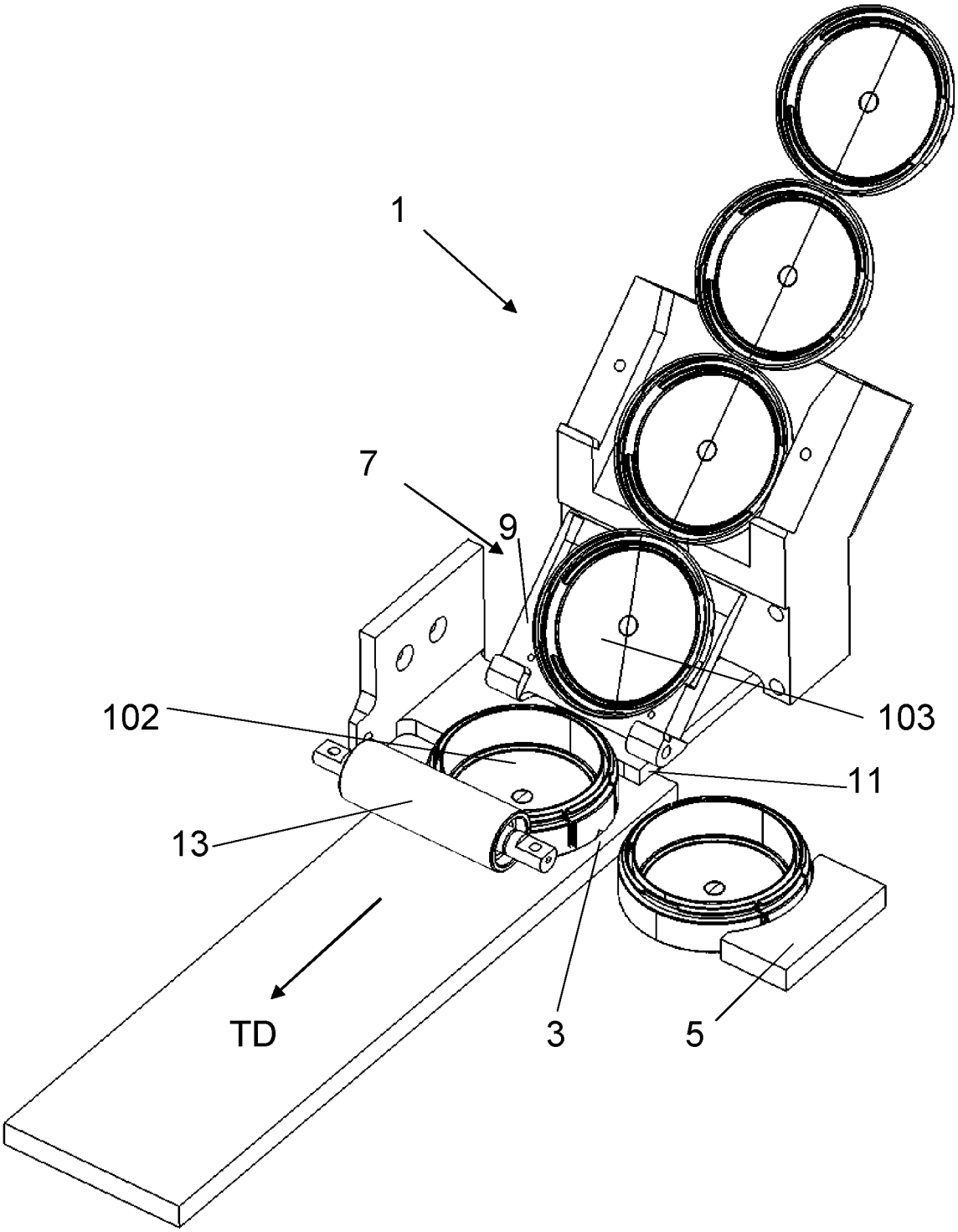
FIG. 3 illustrates an apparatus according to the invention.

FIG. 3 illustrates a perspective view of an apparatus 1 for attaching a lid to a base portion according to the invention. By utilizing an apparatus as described herein, it is possible to attach the lid 103, 203 to the base portion 102, 202 in a lenient and safe way, which is described in detail below.

In FIG. 3, the base portion and the lid are as an illustrating example depicted as the base portion 102 and the lid 103 of the user container 101 shown in FIG. 1*a-b*. However, the apparatus 1 as described herein is very versatile and works well for many different kinds of configurations of the base portion and/or lid, going from simple configurations to very complex and sophisticated ones, including a user container 201 with a disposal compartment 209, as illustrated in FIG. 2*a-c*.

The apparatus 1 comprises a support 3, a base portion feeder 5, a lid positioner 7, comprising a lid holder 9, and a mover 11. The base portion feeder 5 is adapted to place a base portion 102, on the support 3, one base portion 102 at the time. The lid positioner 7 is movable between a lid pick-up position, illustrated in FIG. 3, and a lid attachment position, described below in conjunction with FIG. 4*c*. In the lid pick-up position of the lid positioner 7, the lid holder 9 is adapted to pick up the lid 103 from a lid feeder, not illustrated in FIG. 3, one lid 103 at the time. The mover 11 is adapted to move the base portion 102 and the lid 103 as a combined unit, once the lid 103 has been placed on the base portion 102, described below in conjunction with FIGS. 4*d* and 4*e*. The combined unit is to be moved in a travel direction TD, which is directed away from the apparatus 1.

As an option, illustrated in FIG. 3, the apparatus comprises a pressure roller 13. The pressure roller 13 is adapted to apply pressure to the lid 103, while the combined unit passes the pressure roller 13, described below in conjunction with FIGS. 4*e* and 4*f*.

The series of figures in FIG. 4*a*-4*h*, showing a cross-sectional view of an apparatus 1, illustrate attachment of a lid on a base portion in another apparatus according to the invention. This series illustrates a cycle of attaching the lid 103 on the base portion 102. After the cycle is performed, or at the end of the cycle when the combined unit 109 has been moved away from the lid holder 9, the apparatus 1 is ready to put on a next lid on a next base portion. The apparatus 1 of FIG. 4*a*-4*h* comprises the corresponding units and components as the apparatus of FIG. 3. The relative positions of the units and components of the apparatus 1 of FIG. 4*a-h* also correspond to those of the apparatus FIG. 3. Hence, for simplicity, the same denotations and reference signs and are used.

Figure 4A:
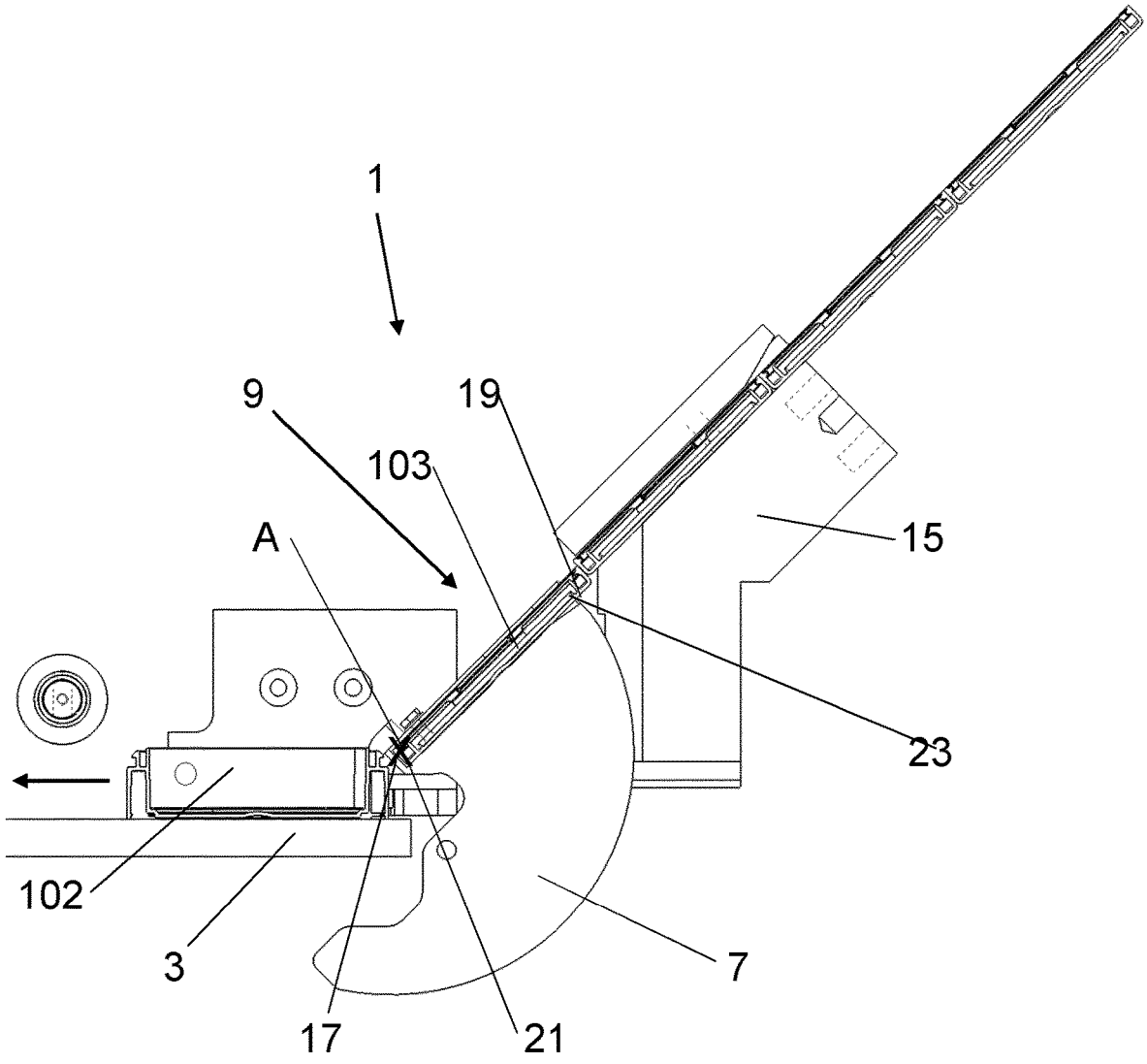
FIG. 4*a*-4*h* illustrate attachment of a lid on a base portion in an apparatus as disclosed herein shown in cross-sectional view.

In the positions depicted in FIG. 4*a*, corresponding to the relative positions of the units and components depicted in FIG. 3, the lid positioner 7 is in the lid pick-up position and the lid holder 9 has picked up a lid 103 from a lid feeder 15. The lid feeder 15 may form part of the apparatus 1 as described herein. A base portion 102 has been placed on the support 3, in a position, in which the base portion 102 is ready to have a lid 103 attached to it. Typically, the base portion 102 is fed into the apparatus 1 after having been filled by the one or more products to be contained in the user container 101, such as a number of pouched products for oral use.

Figure 4B:
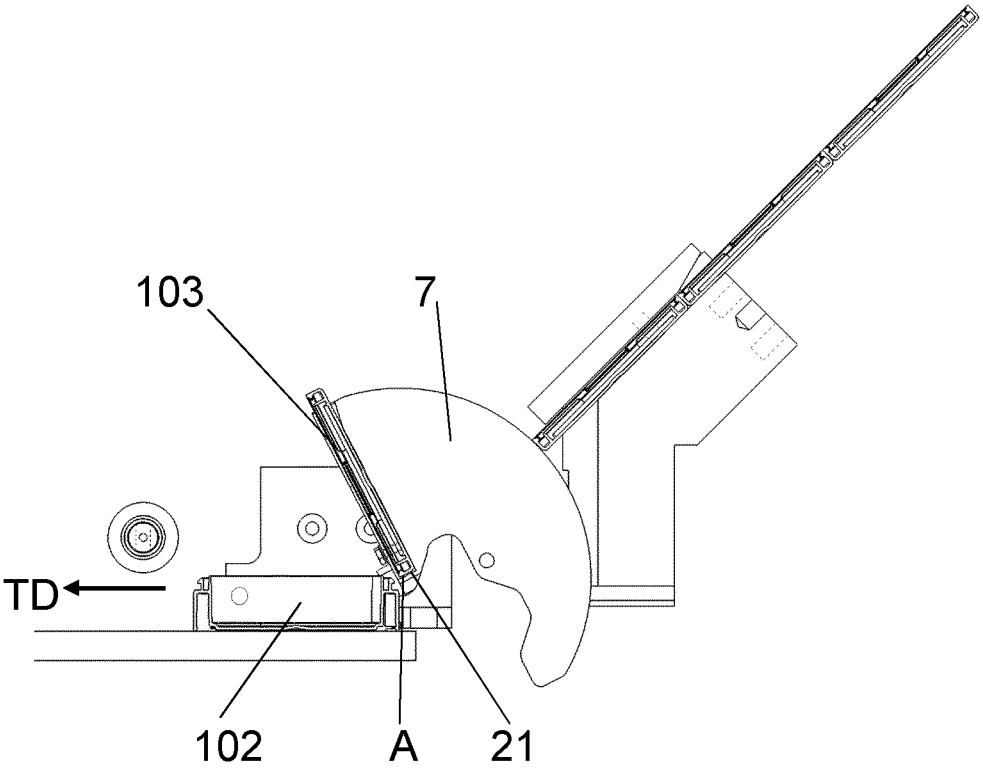
Figure 4C:
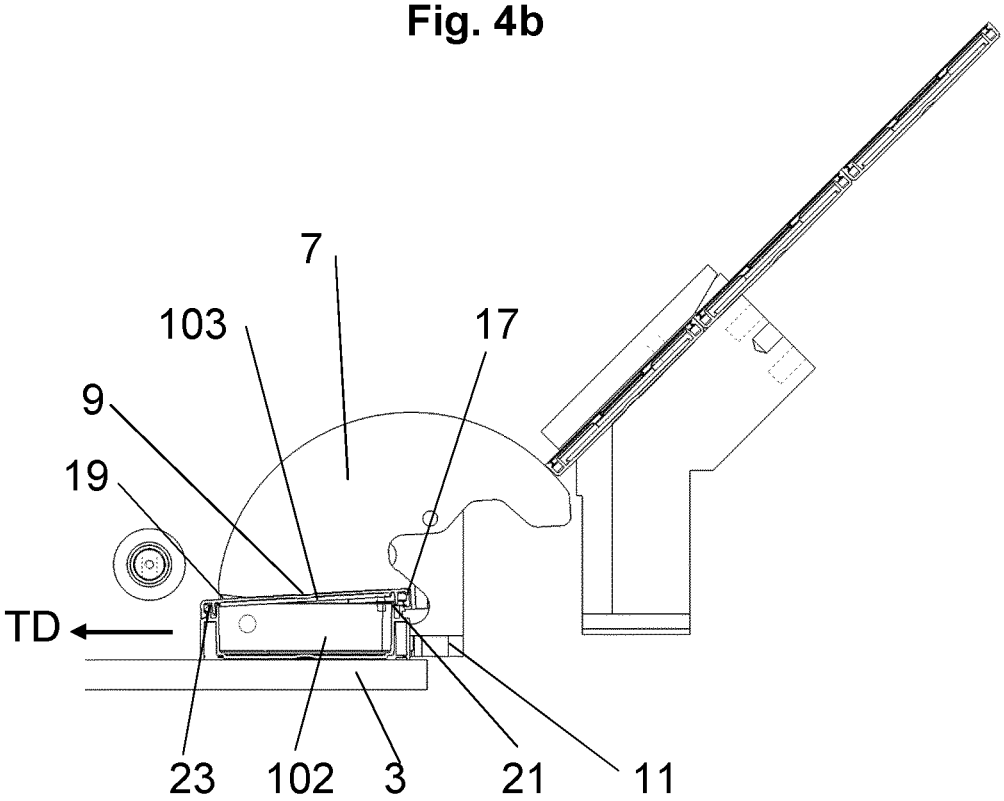

The lid positioner 7 comprises a rotation axis A, marked by an x in FIG. 4*a*, such that the lid positioner is movable from the lid pick-up position, illustrated in FIG. 4*a*, to the lid attachment position, illustrated in FIG. 4*c*, by means of a rotation around the rotation axis A. In the illustrated example, the rotation axis A is located adjacent to a rear portion 17 of the lid holder 9. The rear portion 17 of the lid holder 9 is taken as seen in the travel direction TD of the mover 11 when the lid positioner 7 is in the attachment position, cf. FIG. 4*c*. The opposite portion of the lid holder 9 as seen in the travel direction TD of the mover 11 when the lid positioner 7 is in the attachment position, is denoted as a front portion 19 of the lid holder 9. Also the lid 103 has a rear portion 21 and a front portion 23, with the relative positions of the rear portion 21 and the front portion 23 being determined as seen in the travel direction TD of the mover 11 when the lid positioner 7 is in the attachment position in a corresponding way as for the lid holder 9, cf.

FIG. 4*c*. However, due to the relative positions of the components in the pick-up position of the lid positioner 7 depicted in FIG. 4*a*, the rear portions 17, 21 are actually forward of the front portions 19, 23.

Due to the rotation of the lid positioner 7 around the rotation axis A, the lid 103 will be pivoted at a pivot axis located adjacent to the rear portion 21 of the lid 103 itself, see FIG. 4*b*. This has proven to be an efficient way of positioning the lid 103 in the desired position in relation to the base portion 102.

The lid positioner 7 is rotated around the rotation axis A until it reaches the attachment position, see FIG. 4*c*. in this position, the lid holder 9 is adapted to hold the lid 103 in a predefinable position in relation to the base portion 102 by the lid holder 9 assuming an angle α in relation to the support 3, with the front portion 19 of the lid holder 9 being located closer to the support 3 than the rear portion 17 of the lid holder 9. See detailed view of the lid holder 9 and the support 3 in FIG. 5. The angle α may be within a range of between 0° and 90°, preferably between 1° and 45°, more preferably between 2° and 30°, most preferably between 3° and 10. With a low angle α, a larger portion of the lid 103 is attached at the same time, while the combined unit 109 is moved by the mover 11. The angle α is preferably adapted to the geometries of the lid 103 and the base portion 102.

Figure 6:
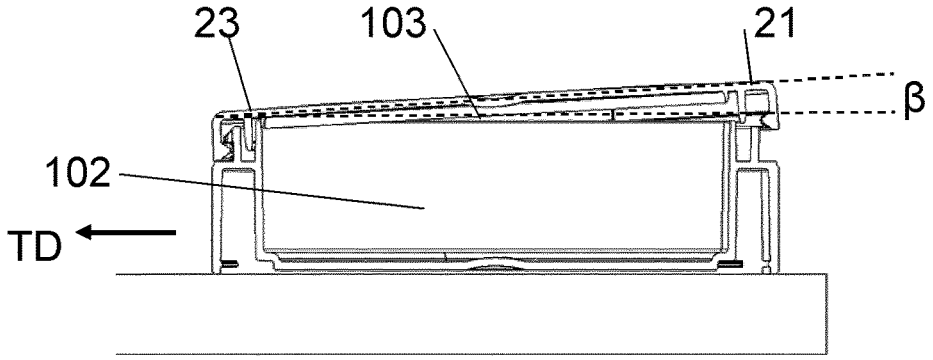
FIG. 6 is a detailed view of the lid and the base portion in the position of FIG. 4*c*.

A corresponding detailed view, showing the base portion 102 and the lid 103 when lid positioner 7 is in the attachment position, as in FIG. 4*c*, is illustrated FIG. 6. Due to the angle α of the lid holder 9, the lid 103 is held in a corresponding angle β in relation to the base portion 102. The angle β may be within a range of between 0° and 90°, preferably between 1° and 45°, more preferably between 2° and 30°, most preferably between 3° and 10°. An angle of 0°, which would correspond to from straight above, i.e. with the lid holder parallel to the support is thus not included in the range. With a low angle β, a larger portion of the lid 103 is attached at the same time, while the combined unit 109 is moved by the mover 11. The angle β is preferably adapted to the geometries of the lid 103 and the base portion 102. Thereby, the front portion 23 of the lid 103 is closer to the base portion 102 than the rear portion 21. The front portion 23 of the lid 103 is the leading end of the lid 103 and the rear portion 21 of the lid 103 is the trailing end as seen in the travel direction TD. Preferably the lid 103 is held so close to the base portion 102 that it abuts the base portion 102 at the front portion 23, as seen in FIG. 4*c* and in the detailed view of FIG. 6. The angle β of the lid 103 in relation to the base portion 102 is directly or indirectly given by the angle α between the support 3 and the lid holder 9. Purely as an example, if both the support 3 and the lid holder 9 have planar surfaces, the lid 103 has a planar or substantially planar top surface held against the lid holder 9 and the base portion 102 has a planar or substantially planar bottom and a straight wall of equal height, the angles α and β typically coincide.

Figure 4D:
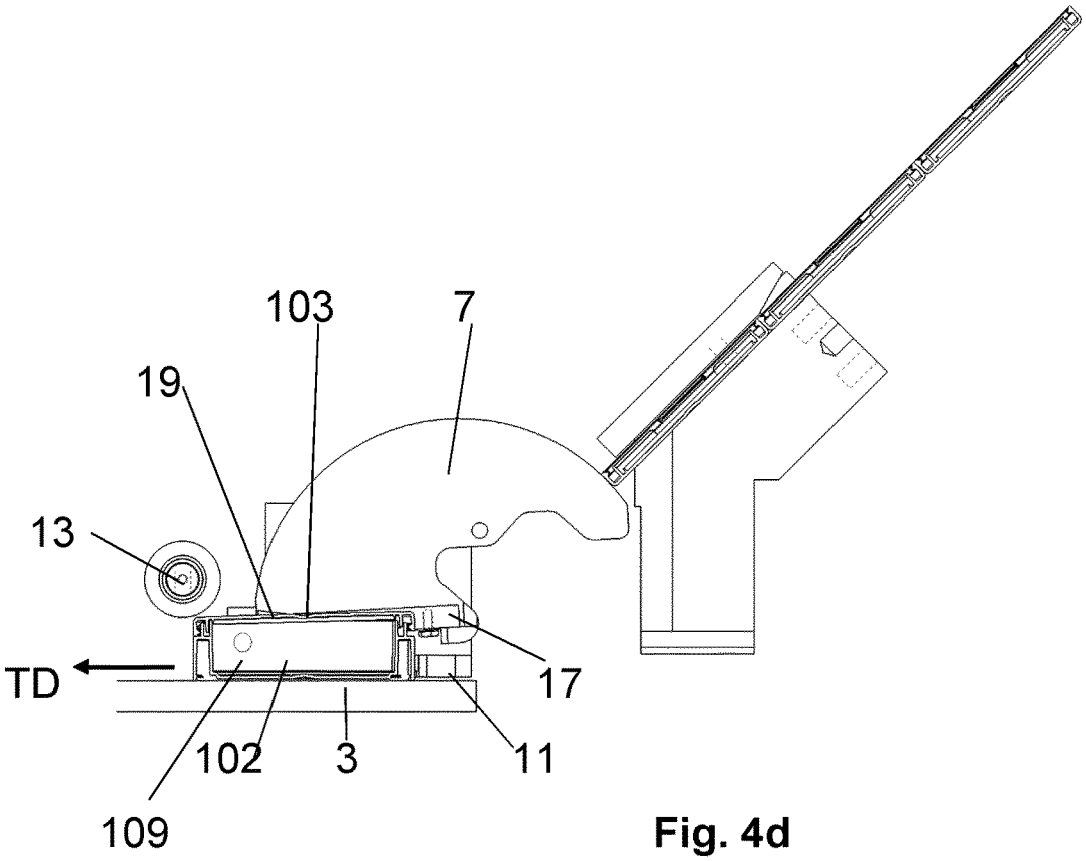
Figure 4E:
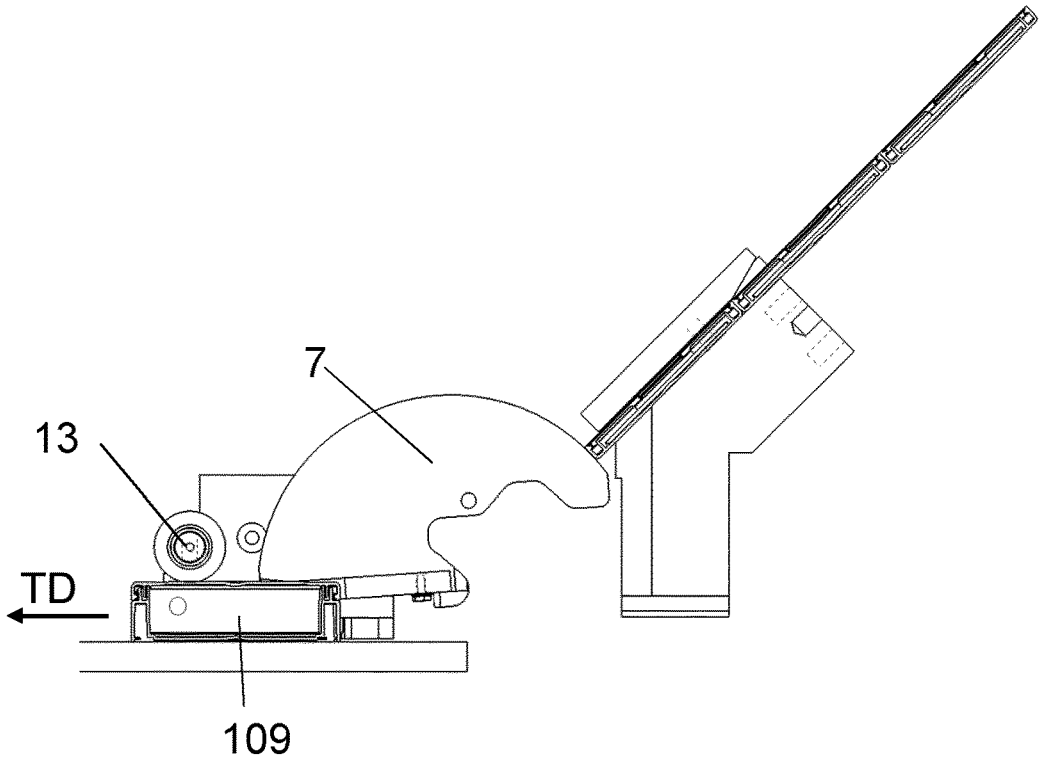

Thereafter, the mover 11 moves the base portion 102 and the lid 103 as a combined unit 109, once the lid 103 has been combined with the base portion 102, i.e. the lid 103 has been placed in contact with the base portion 102, see FIGS. 4*d* and 4*e*. The combined unit 109 is moved in the travel direction TD, i.e. in a direction from the rear portion 17 towards the front portion 19 of the lid holder 9. Due to the front portion 19 of the lid holder 9 being closer to the support 3 than the rear portion 17, the lid 103 is successively attached to the base portion 102 by being pressed down by the front portion 19 of the lid holder 9, while the combined unit 109 is moved in the travel direction TD in a gap between the lid holder 9 and the support 3. The distance between the lid holder 9 and the support 3 is adapted to the heights of the base portion 102 and the lid 103 to be combined, such that the front portion 19 of the lid holder 9 is able to apply the pressure used to put the lid 103 on the base portion 102.

Downstream of the lid holder 9, the combined unit 109 reaches the optional pressure roller 13. The pressure roller 13 is adapted to apply pressure to the lid 103, while the combined unit 109 passes the pressure roller 13 in a gap between the support 3 and the pressure roller 13, see FIGS. 4*e* and 4*f*. In case the user container 101 was not closed in the gap between the lid holder 9 and the support 3, by the lid 103 only being brought in physical contact with the base portion 102, the pressure roller 13 may be used to close the user container 101 by applying pressure to the lid 103, e.g. thereby activating snap-in elements. The pressure roller 13 may thus be used to ascertain that the lid 103 is properly attached to the base portion 102.

Figure 4F:
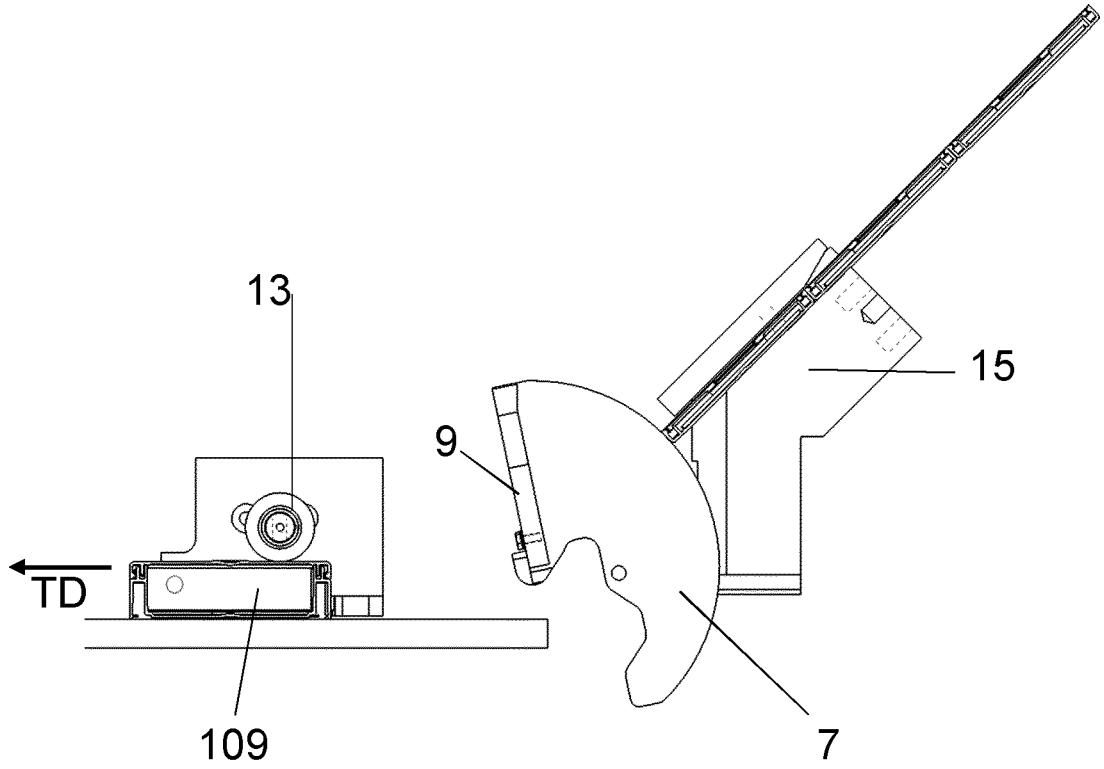
Figure 4G:
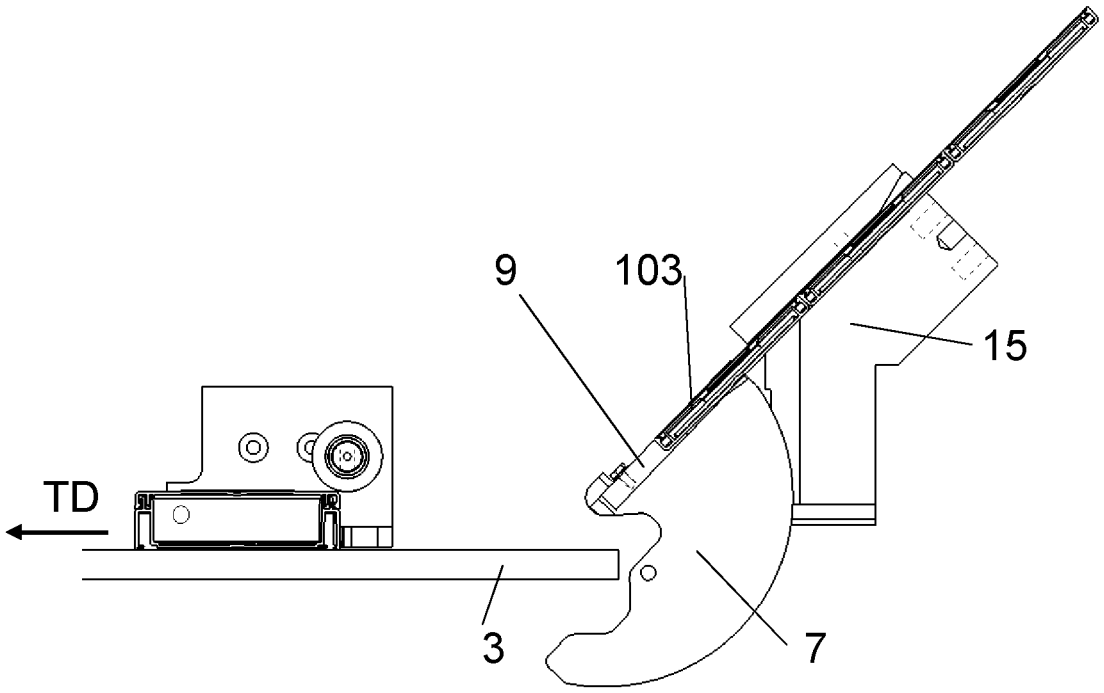

When the combined unit 109 has left the lid holder 9, the lid positioner 7 is rotated back towards the pick-up position, see FIG. 4*f*. Once, the lid positioner 7 has reached the pick-up position, the lid holder 9 is ready to pick up a new lid, see FIGS. 4*g* and 4*h* and the base portion feeder, not seen in the view of FIG. 4*a*-4*h*, is adapted to place a base portion on the support 3. Thereafter, the cycle is completed.

Figure 4H:
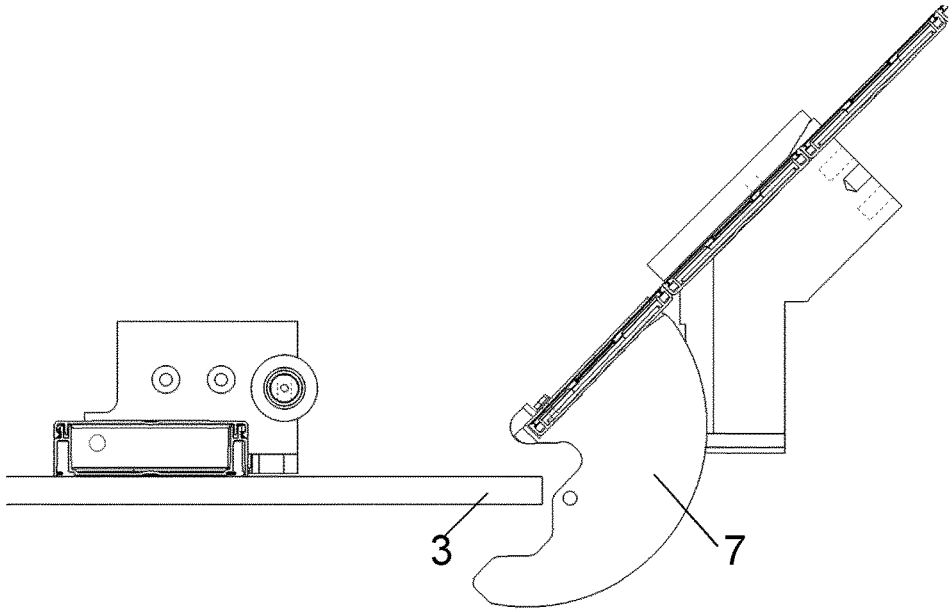
Figure 5:
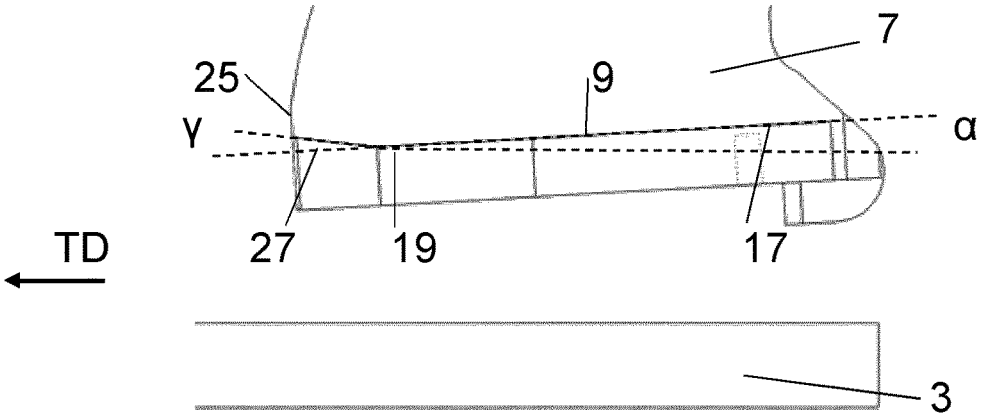
FIG. 5 is a detailed view of the apparatus in the position of FIG. 4*c*.

As an option, present in the illustrated apparatus 1 shown in FIG. 4*a*-4*h* and best seen in FIG. 5, a front edge portion 25 of the front portion 19 of the lid holder 9 may comprise a lid guide 27, the front edge portion 25 forming a frontmost part of the front portion 19 of the lid holder 9 The lid guide 27 comprises an angled surface, which is angled in another direction as compared to the angle α of the lid holder 9 relative to the support 3, preferably in an opposite direction as is illustrated. The lid guide 27 may have a maximal extension in the range of 1-15 mm, preferably in the range of 5-10 mm as measured in the travel direction TD, when the lid positioner 9 is in the attachment position. The angle γ of the lid guide 27 in relation to the rest of the lid holder 9 may be in the range of between 0° and 30°, preferably between 0° and 15°, more preferably between 1° and 10°. The lid guide 27 is adapted to guide the lid 103 when it is moved from the lid feeder 15 to the lid positioner 7, see FIG. 4*g*, especially at the start of the pick-up of the lid 103. The lid 103 is then moved onto the lid holder 9 by passing the front edge portion 25 of the lid holder 9. By providing the lid guide 27, the lid 103 is easily transferred from the lid feeder 15 to the lid holder 9. In particular, the lid guide 27 helps to reduce, or avoid, the risk that the lid 103 gets stuck on the front edge portion 25 of the front portion 19 of the lid holder 9.

Figure 7:
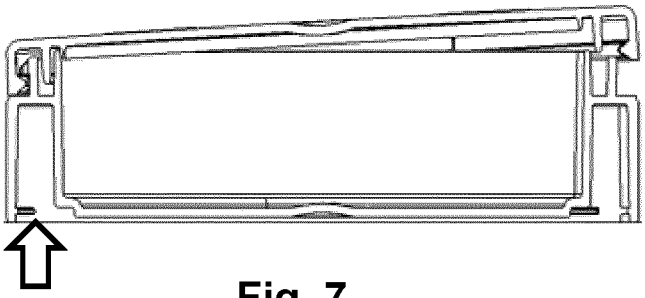
FIG. 7 illustrates an alternative way of positioning the lid.

As an alternative or a complement for positioning the lid in the desired position in relation to the base portion, the support may comprise a local protrusion adapted to move a front portion of the base portion towards the lid holder, see FIG. 7, in which an arrow indicates the movement of the front portion of the base portion. The local protrusion may e.g. be a hump or a cylinder. The local protrusion may be permanent, i.e. present all the time in the support, or the local protrusion may be activated during the lid attachment. The local protrusion helps to lift the front portion of the base portion towards the lid, such that the lid assumes the desired angle in relation to the base portion. Thereafter, the combined unit of the lid and base portion is moved by the mover. As the combined unit passes over the local protrusion, the lid is successively attached to the base portion by the base portion being pressed upwards by the local protrusion. The local protrusion thereby has a size and location adapted such that it only presses a part of the base portion upwards, the part typically being less than half.

Figure 8:
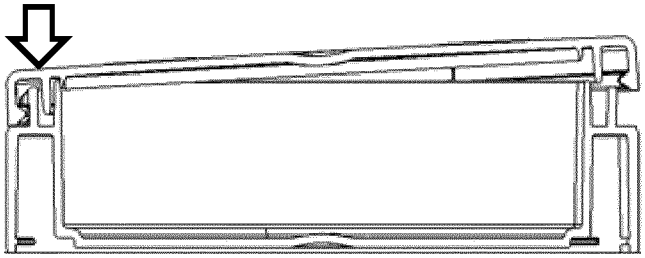
FIG. 8 illustrates another alternative way of positioning the lid.

As yet an alternative or a complement for positioning the lid in the desired position in relation to the base portion, the lid holder may comprise a local protrusion adapted to move a front portion of the lid towards the support, see FIG. 8, in which an arrow indicates the movement of the front portion of the lid. The local protrusion may e.g. be a hump or a cylinder. The local protrusion may be permanent, i.e. present all the time in the lid holder, or the local protrusion may be activated during the lid attachment. The local protrusion helps to lower the front portion of the lid towards the base portion, such that the lid assumes the desired angle in relation to the base portion. Thereafter, the combined unit of the lid and base portion is moved by the mover. As the combined unit passes below the local protrusion, the lid is successively attached to the base portion by the lid being pressed downwards by the local protrusion. The local protrusion thereby has a size and location adapted such that it only presses a part of the lid downwards, the part typically being less than half.

Figure 9:
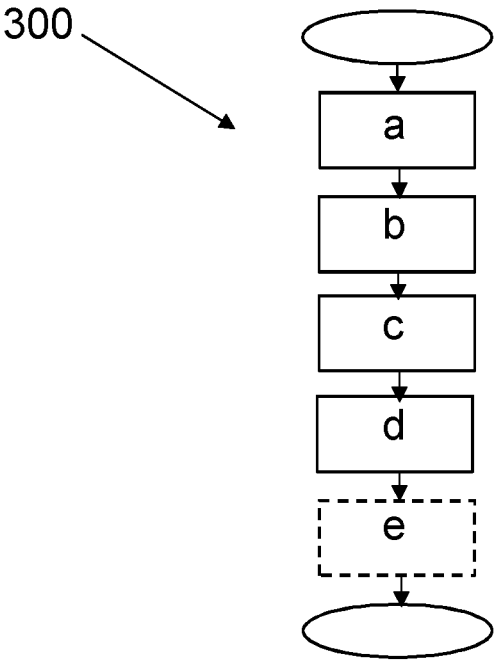
FIG. 9 illustrates a method as disclosed herein.

The present invention further relates to a method 300 for attaching a lid 103, 203 to a base portion 102, 202, the lid 103, 203 and the base portion 102, 202 forming parts of a container, e.g. a user container 101, 201 for a pouched product for oral use, see FIG. 9.

The method comprises:

a) providing the lid, b) providing the base portion 102, 202 and placing it on a support 3, c) positioning the lid 103, 203 in a predefinable position in relation to the base portion 102, 202 by means of a lid holder 9, in which the lid 103, 203 assumes an angle β in relation to the base portion 102, 202, with a front portion 23 of the lid 103, 203 being located closer to the base portion 102, 202 than a rear portion 21 of the lid 103, 203, preferably the front portion 23 of the lid 103, 203 abutting the base portion 102, 202, d) moving the base portion 102, 202 and the lid 103, 203 as a combined unit 109 in a travel direction TD going from the rear portion 21 towards the front portion 23 of the lid holder 9, such that the lid 103, 203 is successively attached to the base portion 102, 202 by the combined unit 109 moving in the travel direction TD in the gap between the front portion 19 of the lid holder 9 and the support 3.

The method 300 may be performed in the apparatus as described 1 herein, see FIG. 3 and FIG. 4*a*-4*h* and the steps described above in conjunction with FIG. 4*a*-4*h*.

In step a), one lid 103 is fed at the time, such that the lid 103 can be picked up by the lid holder 9 with the lid positioner 7 being in the pick-up position, see FIGS. 3, 4*a* and 4*h*.

Step b) may be performed by the base portion feeder 5 described herein, see FIG. 3.

Step c) may be performed by the lid positioner 7 described herein, see FIGS. 4*c*, 5 and 6. The details about the angle β of the lid 103 are described above in conjunction with the description of FIG. 6.

The moving in step d) may be performed by the mover 11 described herein, see FIGS. 4*d* and 4*e*.

Step c) comprises positioning the lid in the predefinable position in relation to the base portion by means of rotation around a rotation axis A, the rotation axis A being located at or adjacent to the rear portion 17 of the lid holder 9, see FIGS. 4*b* and 4*c*. Thereby, the lid 103, 203 is pivoted at a pivot axis located at or adjacent to the rear portion 21 of the lid itself. This has proven to be an efficient way of positioning the lid 103, 203 in the desired position in relation to the base portion 102, 202.

As an alternative or a complement, step c) may comprise positioning the lid in the predefinable position by means of moving a front portion of the base portion towards the lid by means of the support. See FIG. 7. This may be performed with the local protrusion of the support described herein.

As yet an alternative or a complement, step c) may comprise positioning the lid in the predefinable position by means of moving the front portion of the lid towards the base portion by means of the lid holder. See FIG. 8. This may be performed with the local protrusion of the lid holder described herein.

Hence, the successive attachment of the lid 103, 203 to the base portion 102, 202 may be achieved in any of the ways described for the apparatus herein or a combination of those ways, such as rotating the lid, locally lifting the base portion towards the and/or locally pressing the lid towards the base portion.

The method may further comprise e) applying pressure to the lid by means of a pressure roller 13, while the combined unit 109 passes the pressure roller 13.

Step e) may be performed by the pressure roller 13 described in conjunction with the apparatus 1, see FIGS. 3, 4*e* and 4*f*.

Further modifications of the invention within the scope of the appended claims are feasible. As such, the present invention should not be considered as limited by the embodiments and figures described herein. Rather, the full scope of the invention should be determined by the appended claims, with reference to the description and drawings.

The invention claimed is:

1. An apparatus for attaching a lid to a base portion, said lid and said base portion forming parts of a container for a pouched product for oral use, said apparatus comprising:

a support, a base portion feeder configured to place said base portion on said support, a lid positioner comprising a lid holder, a mover configured to move said base portion and said lid as a combined unit in a travel direction, said lid positioner being movable between a lid pick-up position and a lid attachment position, said lid holder in said lid pick-up position of said lid positioner being configured to pick up said lid, said lid holder having a front portion and a rear portion as seen in said travel direction when said lid positioner is in said attachment position, wherein said lid positioner comprises a rotation axis, such that said lid positioner is movable from said lid pick-up position to said lid attachment position by rotation around said rotation axis, said rotation axis being located at or adjacent to said rear portion of said lid holder, said lid thereby being pivoted at a pivot axis located at or adjacent to a rear portion of said lid, wherein said lid positioner is configured to be rotated back towards said lid pick-up position when said combined unit has left said lid holder, said lid holder in said attachment position of said lid positioner being configured to hold said lid in a predefined position in relation to said base portion by said lid holder assuming an angle in relation to said support, with said front portion of said lid holder being located closer to said support than said rear portion of said lid holder, and said mover being configured to move said combined unit in said travel direction from said rear portion towards said front portion of said lid holder.

2. The apparatus according to claim 1, wherein said angle is within a range of between 0° and 90°.

3. The apparatus according to claim 1, wherein a surface of said support is horizontal and said lid holder assumes said angle $\alpha$ in relation to a horizontal plane when in said attachment position of said lid positioner.

4. The apparatus according to claim 1, wherein a front edge portion of said front portion of said lid holder comprises a lid guide, said front edge portion forming a frontmost part of said front portion, said lid guide comprising an angled surface, which assumes an angle in relation to a surface of the remaining portion of said lid holder, wherein said angle is within a range of between 0° and 30°.

5. The apparatus according to claim 1, wherein said lid positioner comprises a single rotation axis.

6. The apparatus according to claim 1, wherein said base portion feeder is configured to feed said base portion from another direction than said travel direction.

7. The apparatus according to claim 1, further comprising a pressure roller located downstream of said lid positioner, said pressure roller being configured to apply pressure to said lid, while said combined unit passes said pressure roller.

8. The apparatus according to claim 1, wherein said angle is within a range from 3° to 10°.

9. A method for attaching a lid to a base portion, said lid and said base portion forming parts of a container for a pouched product for oral use, said method comprising:

a) providing said lid, b) providing and placing said base portion on a support, c) positioning said lid in a predefined position in relation to said base portion by a lid positioner comprising a lid holder, wherein said lid assumes an angle in relation to said base portion, with a front portion of said lid being located closer to said base portion than a rear portion of said lid, d) moving said base portion and said lid as a combined unit in a travel direction going from a rear portion towards a front portion of said lid holder, such that said lid is successively attached to said base portion by said combined unit moving in said travel direction in a gap between said front portion of said lid holder and said support, wherein step c) comprises positioning said lid in said predefined position by rotation around a rotation axis, said rotation axis being located at or adjacent to said rear portion of said lid holder, said lid thereby being pivoted at a pivot axis located at or adjacent to said rear portion of said lid itself, and wherein said method further comprises rotating said lid positioner back towards said lid pick-up position when said combined unit has left said lid holder.

10. The method according to claim 9, wherein said angle is within a range of between 0° and 90°.

11. The method according to claim 9, wherein step b) comprises feeding said base portion from another direction than said travel direction.

12. The method according to claim 9, wherein step c) comprises positioning said lid in said predefined position by moving a front portion of said base portion towards said lid by said support.

13. The method according to claim 9, wherein step c) comprises positioning said lid in said predefined position by moving said front portion of said lid towards said base portion by said lid holder.

14. The method according to claim 9, wherein said method further comprises e) applying pressure to said lid by a pressure roller, while said combined unit passes said pressure roller.

15. The method according to claim 9, wherein said angle is within a range from 3° to 10°.

* * * * *